US006253754B1

(12) United States Patent
Ward

(10) Patent No.: US 6,253,754 B1
(45) Date of Patent: Jul. 3, 2001

(54) DURABLE BOWSTRING AND BUSS CABLE

(76) Inventor: Dennis R. Ward, 807 N. Mesa Ave., Wilcox, AZ (US) 85643-1425

( * ) Notice: Subject to any disclaimer, the term of this patent is extended or adjusted under 35 U.S.C. 154(b) by 0 days.

(21) Appl. No.: 09/563,543

(22) Filed: May 1, 2000

(51) Int. Cl.[7] ..... F41B 5/14
(52) U.S. Cl. ..... 124/90
(58) Field of Search ..... 124/90

(56) References Cited

U.S. PATENT DOCUMENTS 2,271,173 * 1/1942 Lay ..... 124/90 X
2,981,053 * 4/1961 Harrison ..... 124/90 X
3,297,013 * 1/1967 Smith et al. ..... 124/90
3,444,853 * 5/1969 Hofmeister ..... 124/90
4,957,094 9/1990 Pickering et al. ..... 124/24.1

* cited by examiner

*Primary Examiner*—John A. Ricci
(74) *Attorney, Agent, or Firm*—Antonio R. Durando

(57) ABSTRACT

Bowstrings and buss cables for compound bows have end servings with improved durability and longer life. The end servings of the bowstrings and cables are formed using flattened multi-fiber material. The multi-fiber material is wrapped in an overlapping fashion around the bowstring and cables where protection is needed. The material is further wrapped with a bias greater than a conventional side-by-side wrapped end serving. The improved servings are either applied over conventional end servings or applied directly over a bowstring as a replacement for conventional end servings. The invention is particularly useful wherever the bowstring contacts an eccentric.

12 Claims, 4 Drawing Sheets

DURABLE BOWSTRING AND BUSS CABLE

BACKGROUND OF THE INVENTION

1. Field of the Invention

This invention is related in general to the field of archery and, in particular, to bowstrings and buss cables for compound bows which provide improved durability.

2. Description of the Related Art

The invention of the compound bow in 1966 was a substantial improvement in bow designs. The compound bow used a series of pulleys (or eccentrics) attached to the ends of the bow limbs. This design resulted in increased arrow velocity and reduced pull needed to hold the bow at full draw.

A problem with the compound bow is increased wear and reduced life of the bowstrings and buss cables. The increased load pressure applied to the end servings as they are bent by the eccentrics cause the end servings to separate, leaving the strings unprotected and subject to wear. The introduction of the single cam bow has exacerbated the problem. The single cam design results in even higher load pressure and bending where the high points or steep angles on the eccentric (or cam) contact the end servings.

Servings currently being used are typically made of two or more strands of material which are either twisted or braided. They are made from a variety of materials ranging from exotic aerospace materials to ordinary fishing line. The servings are applied over the bow string or buss cable in a side-by-side fashion (FIG. 1).

FIG. 1 illustrates a prior art end serving and a separation of the end serving. Bowstring 12 is protected by prior art end serving 12A. End serving 12A is made by wrapping a serving material around bowstring 12 in a side-by-side fashion. The serving material is wrapped as tightly as possible. Since the serving material is wrapped side-by-side, it is applied at nearly a 90 degree angle to bowstring 12. Even though serving material is wrapped very tightly, it is susceptible to separation 23 as bowstring 12 stretches and is subject to the high load pressure of the eccentric. Once separation occurs, the bowstring fibers are left unprotected from wear by the eccentric. The separation is unsightly and, left unprotected, bowstring 12 can become worn and break. Also shown is loop 22.

The end serving can begin to separate after only a few shots. After several more shots the serving can be separated to the point that the bowstrings or cable begin to ride directly on the eccentric and cause severe wear. The end serving is supposed to protect the strings from this type of wear.

Replacing the bowstring and cables can be costly and time consuming. Further, a broken bowstring or cable renders the bow inoperable and may even cause damage to the bow or injury to the user. The purchaser of a new bow may also assume that the manufacturer has supplied poor quality bowstring and cables on the new bow.

The prior art has attempted to solve durability problems by using new bowstring materials and/or redesigned eccentrics. An example of the prior art is illustrated by U.S. Pat. No. 4,957,094, issued Sep. 18, 1990, to Pickering et al. which is incorporated herein by reference.

Clearly there exits the need for improved bowstrings and buss cables which are durable, safer, reduce breakage and resist unsightly separation.

BRIEF SUMMARY OF THE INVENTION

The invention discloses bowstrings and buss cables for compound bows having end servings with improved durability and longer life. The end servings of the bowstrings and cables are formed using flattened multi-fiber material. The multi-fiber material is wrapped in an overlapping fashion around the bowstring and cables. The material is further wrapped with a bias greater than a conventional side-by-side wrapped end serving. The improved servings are either applied over conventional end servings or applied directly to a bowstring as a replacement for conventional end servings. In general, the invention is useful anywhere on the bowstring where there is contact with an eccentric or the like.

The increased durability and longer life provide many advantages. One important advantage is safety to both the bow and the user. If a bowstring breaks, it can both damage the bow and injure the user. The invention reduces the chances of this type of damage. Another important advantage is cost. Replacement bowstrings and cables can cost in the range of $55 to $75. There is also the installation cost and/or time associated with the repair and the inconvenience to the archer of returning and sighting the bow. Finally, the invention improves the appearance of the bow by reducing unsightly separation. The terms "bowstring" and "buss cable" are merely used to designate particular parts in the stringing of a bow by the generally recognized nomenclature. Since the invention is equally applicable to either the bowstring or buss cables, the terms will be used interchangeably in this application and/or the term "bowstring/cable" will be used.

The term "eccentric" is used here to refer to the rotatably mounted items attached to the ends of the bow limbs. For purposes of this application the terms "eccentric" and "cam" are used interchangeably. The term "eccentric" is not meant to be limited to a particular shape but is meant to refer to any such rotatable device attached to the limb tip of any compound bow known in the art.

The preferred embodiment uses a multi-fiber material which is sufficiently flat or deformable such that the material may be overlapped as it is wrapped around a bowstring. Since the material is overlapping it resists separation better than conventional side-by-side wrapping. It is also envisioned that some single fiber materials may be used.

The multi-fiber material is also wrapped with a bias. Conventional servings are wrapped side-by-side resulting in almost no bias since the serving material is at nearly a 90 degree angle to the bowstring. The increased bias of the invention further resists separation.

Therefore, an object of the invention is to provide an improved bowstring.

A feature of the invention is overlapping end servings.

Another feature of the invention is a biased end serving.

Another feature of the invention is a multi-fiber material suitable for overlapping.

Advantages of the invention include increased durability, reduced breakage, increased bowstring life, increased safety, reduced operating cost, reduced inconvenience to the archer, easily installed during production of bowstrings and improved appearance.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only one of the various ways in which the invention may be practiced.

DESCRIPTION OF THE PREFERRED EMBODIMENT OF THE INVENTION

Figure 1:
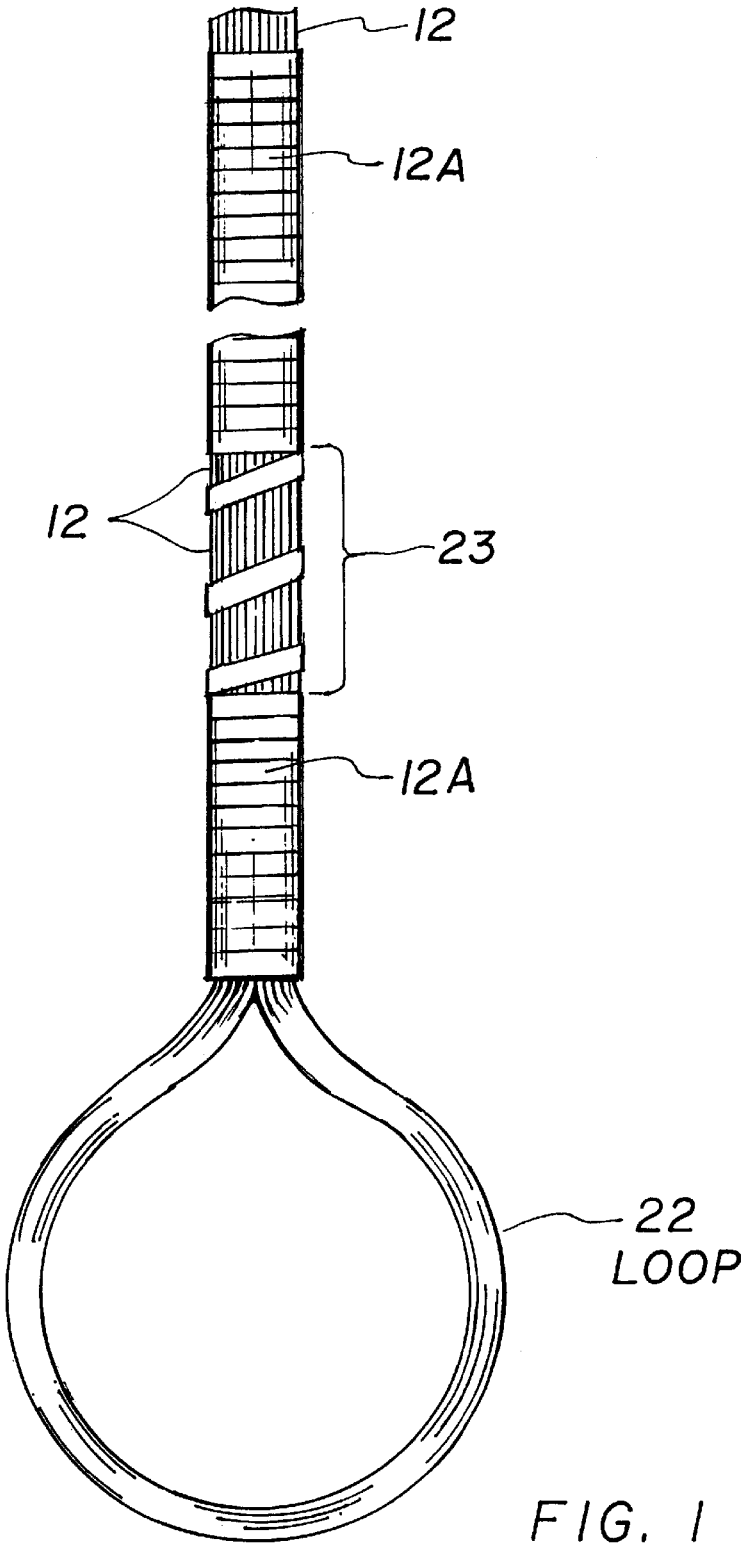
FIG. 1 PRIOR ART
FIG. 1 illustrates a prior art end serving and separation.
Figure 2:
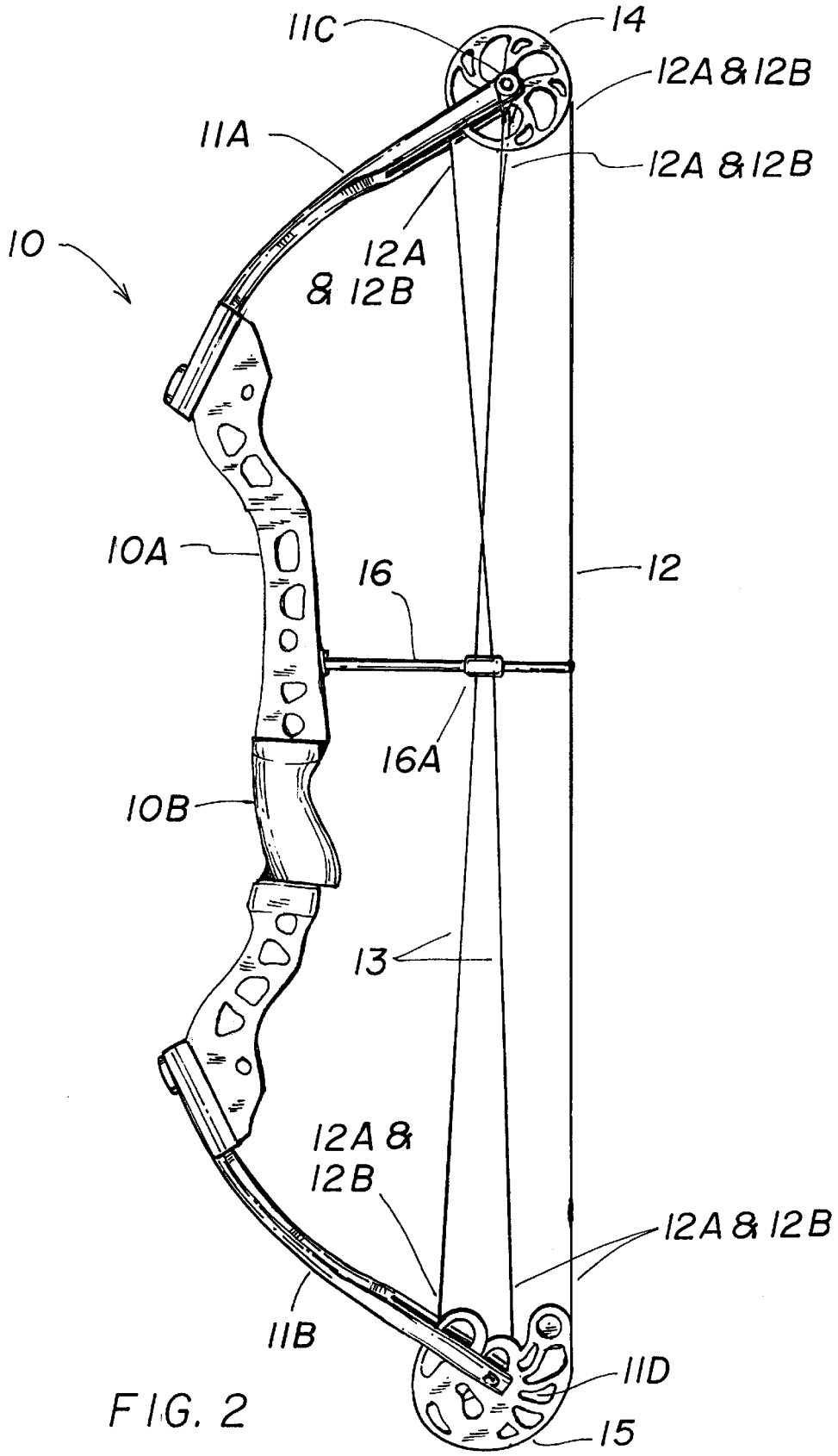
FIG. 2 shows a compound bow.

FIG. 2 shows a conventional single cam compound bow 10. Elements of bow 10 include riser 10A, grip 10B, upper limb 11A, lower limb 11B, limb tips 11C and 11D (also referred to as free ends), bowstring 12, buss cables 13, end servings 12A, end portions 12B, idler wheel 14, eccentric 15 and cable guard 16 with cable slider 16A.

End servings 12A are located at several positions on bowstring 12 and buss cables 13. End servings 12A protect the bowstring 12 and cables 13 from wear. Servings 12A are particularly critical in protecting strings from the high load pressure exerted when in contact with eccentric 15 and, to a lesser extent, idler wheel 14. The invention provides improved end servings for protecting bowstrings 12 and cables 13 from wear. End portions 12B refer to the parts of the bowstring and cables where end servings are applied.

For this application it should be noted that the end servings may be applied to any portion of the bowstring that comes into contact with an eccentric, idler wheel, or the like. The invention is not intended to be limited only to the "end" of the bowstring as the term "end serving" implies.

Figure 3:
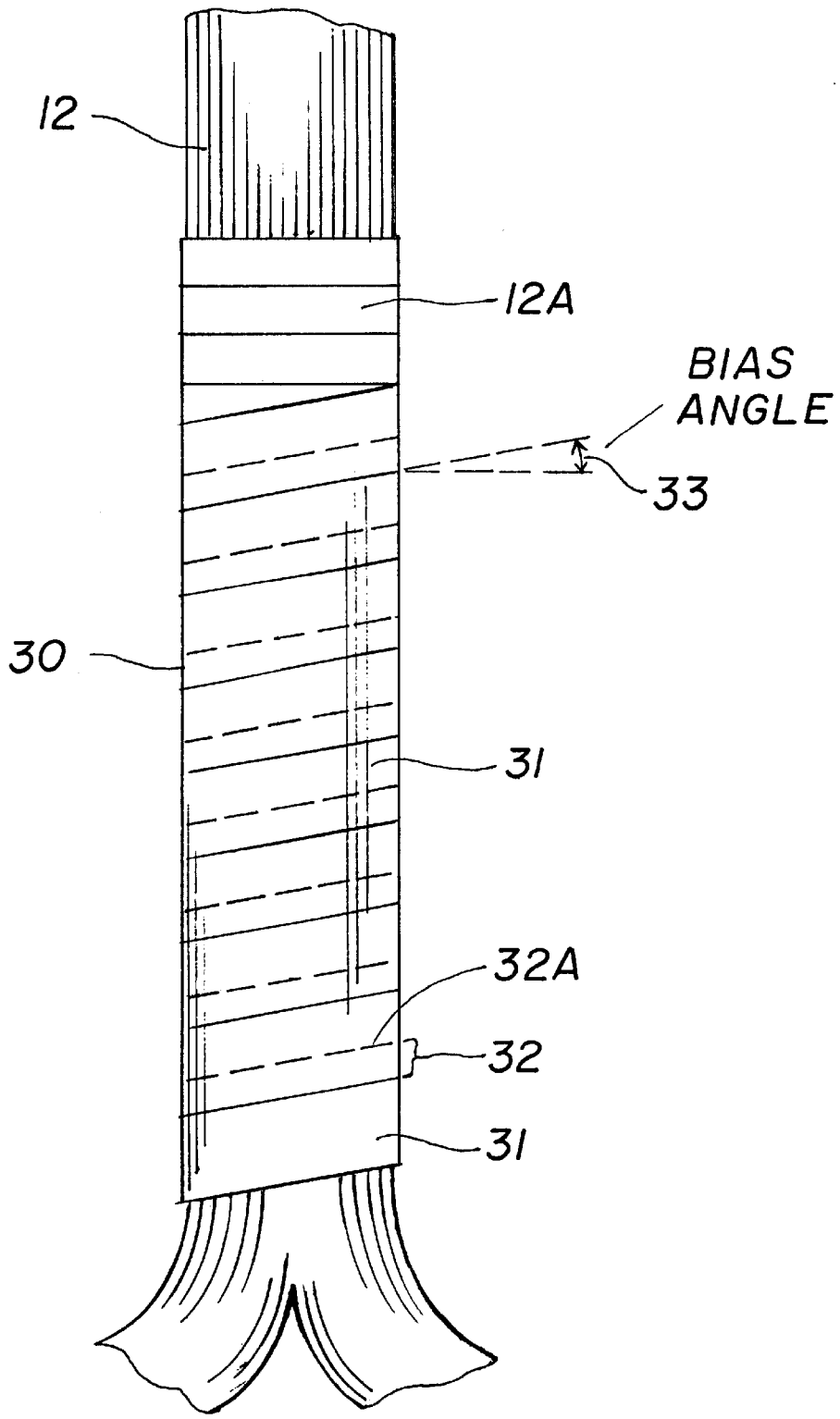
FIG. 3 illustrates the overlapping and bias features of the invention.

FIG. 3 illustrates the overlapping feature of the invention. Improved end serving 30 is wrapped around bowstring 12 in an overlapped fashion. Dashed lines 32A represent the hidden edge of the overlapped serving fiber or serving material 31. The optimum amount of overlap has not been thoroughly tested; however, the preferred embodiment uses an overlap of approximately 25% of the width of the serving material. The use of this overlap technique helps prevent separation even if bowstring 12 stretches. It is envisioned that varying amounts of overlap will be used depending on factors such as the stretching characteristics of a particular bowstring material, the load pressure applied to the bowstring and the shape of the eccentric (e.g., the amount of curvature at the high point of the eccentric can influence the amount of load pressure exerted on a part of the bowstring).

FIG. 3 also illustrates the bias application of serving material. Bias angle 33 is defined for this application as shown by bias angle 33. Bias angle 33 represents the angle between serving material 31 and the perpendicular to bowstring 12. Conventional end servings are wrapped side-by-side and have a bias angle approaching zero degrees. The invention uses a bias angle greater than conventional servings. The optimal bias angle has not been determined; however, the preferred embodiment uses a bias angle of approximately 25 degrees. It is envisioned that the optimal bias angle will be influenced by factors such as load pressure, eccentric shape and bowstring stretch characteristics.

Figure 4:
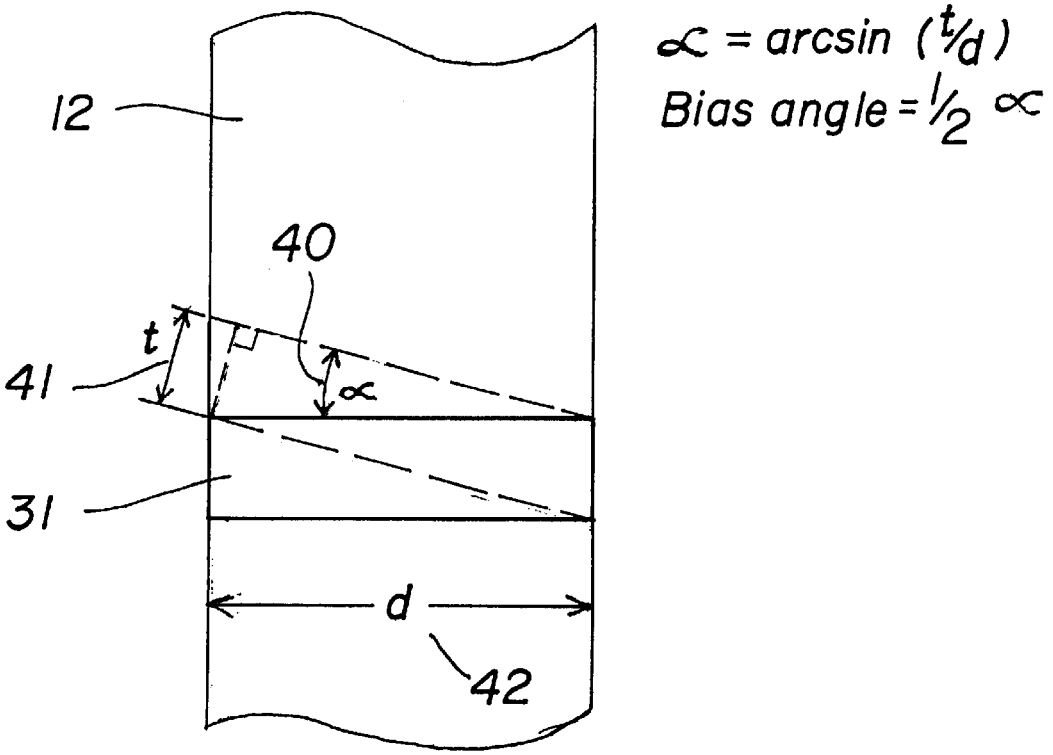
FIG. 4 illustrates the bias angle computation for conventional end servings.

FIG. 4 illustrates the computation of the bias angle for conventional side-by-side wrapped end servings. Shown in FIG. 4 are wrap angle ($\alpha$) 40, bowstring 12, serving material 31, serving material diameter (t) 41 and bowstring material diameter (d) 42. The dashed lines indicate the position of serving material 31 hidden by bowstring 12. Wrap angle ($\alpha$) is calculated as:

$$\alpha = \arcsin(t/d)$$

Wrap angle ($\alpha$) represents the bias angle for one complete wrap around bowstring 12. Therefore, the bias angle for conventionally wrapped end servings as defined in FIG. 3 will be approximately:

$$\text{Bias Angle} = \tfrac{1}{2}\alpha$$

Since the wrapping of the end serving is not always precisely the same for each revolution of the end serving material, we use the phase "average bias angle" to represent the average of the bias angle for a plurality of revolutions of end serving material.

Although it is intended that the overlapping and biasing features be used in combination, either of the features can be used alone (e.g., an end serving can be wrapped at a bias angle without any overlap or an end serving can be wrapped with an overlap without the increased bias).

Serving material 31 may be of any suitable material of sufficient strength and capable of being overlapped and/or biased. The preferred embodiment uses a single-strand multi-fiber material identified as SPECTRA and manufactured by Western Filament, Inc. of Grand Junction, Colo.

The method of the invention follows from the description above. A bowstring and suitable serving material are provided. The serving material is applied to the bowstring by wrapping the serving material around the end portion of the bowstring a plurality of times. The serving material is applied in an overlapping fashion. The serving material is also applied with a bias greater than a conventional side-by-side wrapped end serving. In other words, the serving material is applied with a bias angle greater than ½ arc sin(t/d) where t is the diameter of the serving material and d is the diameter of the bowstring. Further, the serving material may be applied or wrapped over a conventional side-by-side end serving.

Various changes in the details, steps and components that have been described may be made by those skilled in the art within the principles and scope of the invention herein illustrated and defined in the appended claims. For example, various kinds of eccentrics, bowstrings, buss cables and components could be used with equivalent results. Similarly, various physical embodiments are also envisioned. Thus, while the present invention has been shown and described herein in what is believed to be the most practical and preferred embodiment, it is recognized that departures can be made therefrom within the scope of the invention, which is not to be limited to the details disclosed herein but is to be accorded the full scope of the claims so as to embrace any and all equivalent processes and products.

I claim:

1. A bowstring/cable comprising:

(a) a string having an end portion; and (b) a serving fiber wrapped around said end portion in an overlapping fashion.

2. The bowstring/cable according to claim 1 wherein said serving fiber is wrapped around said end portion with a bias angle greater ½ arc sin (t/d).

3. The bowstring/cable according to claim 1 wherein said serving fiber is applied over a conventional side-by-side wrapped end serving.

4. The bowstring/cable according to claim 1 wherein said serving fiber is a multi-fiber material.

5. A bowstring/cable for compound bows comprising:

(a) a string having an end portion; and (b) a serving fiber wrapped around said end portion and having a bias angle greater than ½ arc sin (t/d);

wherein t is a diameter of the serving fiber and d is a diameter of the string.

6. The bowstring/cable for compound bows according to claim 5 wherein said serving fiber is wrapped around said end portion in an overlapping fashion.

7. The bowstring/cable for compound bows according to claim 5 wherein said serving fiber is applied over an existing side-by-side wrapped end serving.

8. A method of applying a serving material to a bowstring\cable to form an end serving, said method comprising the steps of:

(a) providing a serving material;

(b) providing a bowstring/cable having and end portion; and (c) wrapping said serving material around said end portion of said bowstring/cable a plurality of times; wherein said serving material is wrapped in an overlapping fashion.

9. The method of applying a serving material according to claim 8 wherein the step of wrapping includes wrapping said serving material with an average bias angle greater than ½ arc sin (t/d);

wherein t is a diameter of the serving material and d is a diameter of the bowstring/cable.

10. The method of applying a serving material according to claim 9 wherein said bowstring/cable includes an existing side-by-side wrapped end serving and the step of wrapping includes wrapping said serving material over said existing end serving.

11. A compound bow comprising:

(a) upper and lower limbs each having a free end;

(b) first and second eccentrics, said first eccentric rotatably attached to said free end of said upper limb and said second eccentric rotatably attached to said free end of said lower limb; and (c) a bowstring/cable having an end portion in contact with at least one of said eccentrics, said bowstring/cable having, (1) a serving material wrapped around said end portion in an overlapping fashion.

12. The compound bow according to claim 11 wherein said serving material is wrapped around said end portion such that the bias angle is greater than ½ arc sin (t/d);

wherein t is a diameter of the serving material and d is a diameter of the bowstring/cable.

* * * * *